US005659906A

United States Patent [19]

Nickell et al.

[11] Patent Number: 5,659,906

[45] Date of Patent: Aug. 26, 1997

[54] FOUR-POINT ROPE SLING HAMMOCK SYSTEM

[75] Inventors: Kevin D. Nickell, Hamersville, Ohio; Howard W. Law, Wilder, Ky.

[73] Assignee: Sportsman's Market, Inc., Batavia, Ohio

[21] Appl. No.: 592,268

[22] Filed: Jan. 26, 1996

[51] Int. Cl.[6] ..... A45F 3/22

[52] U.S. Cl. ..... 5/122; 5/120

[58] Field of Search ..... 5/120, 122, 123, 5/127

[56] References Cited

U.S. PATENT DOCUMENTS

| | | | |
|---|---|---|---|
| 113,307 | 4/1871 | Kirsch | 5/123 |
| 142,327 | 9/1873 | Craft | 5/122 |
| D. 229,598 | 12/1973 | Westrich . | |
| D. 229,599 | 12/1973 | Westrich . | |
| 717,119 | 12/1902 | Potter . | |
| 816,340 | 3/1906 | Knoerschild . | |
| 1,400,049 | 12/1921 | Goddard . | |
| 2,571,037 | 10/1951 | Hoffman . | |
| 2,710,413 | 6/1955 | McArthur . | |
| 3,315,281 | 4/1967 | Morris . | |
| 3,321,780 | 5/1967 | Morris . | |
| 3,526,909 | 9/1970 | Kotler . | |
| 3,550,166 | 12/1970 | Kotler . | |
| 3,593,352 | 7/1971 | Britt . | |
| 3,606,621 | 9/1971 | Betsche . | |
| 3,783,458 | 1/1974 | Westrich . | |
| 4,229,845 | 10/1980 | De Cuadros | 5/127 |
| 4,925,138 | 5/1990 | Rawlins | 5/127 |
| 5,003,652 | 4/1991 | Bayless | 5/127 |
| 5,035,012 | 7/1991 | Westrich . | |
| 5,095,563 | 3/1992 | Miller | 5/127 |

FOREIGN PATENT DOCUMENTS

| | | | |
|---|---|---|---|
| 102898 | 12/1936 | Australia | 5/120 |
| 1010226 | 1/1950 | France | 5/122 |

OTHER PUBLICATIONS

Algoma Net Company Brochure, "Great Lakes Hammocks, Chairs, Benches" at p. 13 (4–Point Rope and Net Lounges) 1991.

*Primary Examiner*—Flemming Saether

*Attorney, Agent, or Firm*—Wood, Herron & Evans, L.L.P.

[57] ABSTRACT

A four-point rope sling hammock system (10) including a rope sling bed (12) connected to a stand (14) by four chains (16, 18, 20, 22) each extending between respective bed spreader bars (34, 36) and stand support members (44A, 44B) in a line generally parallel to the longitudinal axis (28) of hammock bed (12).

5 Claims, 2 Drawing Sheets

FOUR-POINT ROPE SLING HAMMOCK SYSTEM

BACKGROUND OF THE INVENTION

I. Field of the Invention

The present invention relates to hammocks and, more specifically, to rope sling hammocks provided with four points of connection to a supporting frame.

II. Description of the Prior Art

Perhaps one of the most common forms of hammocks is the rope sling hammock. The rope sling hammock is made up of intermeshed rope, usually cotton cords, connected to a pair of spreader bars at each end of the hammock bed. The ropes also interconnect to a chain at each end of the bed with each chain extending to a connection element, such as a hook, on a hammock stand to thus provide two points of connection between the bed and stand.

While these traditional 2-point hammocks are widely used and enjoyed, various efforts have been attempted over the years to improve the utility of such hammocks. One particular problem with the traditional two-point hammock construction is that the supporting stand must be very long to accommodate the rope sling bed therebetween with enough tension to desirably support an individual in the hammock bed. One solution has been to provide four points of connection rather than two between the bed and the stand. In a typical four point connection system, each end of the hammock bed is to be connected directly to the stand and so the stand can be shortened to match the length of the bed. Where canvas beds were used, the ends of the beds could be sewn around the stand support bars. That type of arrangement is not readily applicable to rope sling hammocks since the ropes are connected with a spreader bar to support them.

To utilize four point connection with rope slings, therefore, further hardware was necessary to connect the spreader bars to the stand. To this end, it was proposed to provide a pair of spaced-apart hooks on each spreader bar to connect directly to a mating pair of hooks at each end of the stand. The resulting four-point connection still allowed for a smaller length stand than conventional rope sling hammocks. But these four-point hammocks suffered from the drawback that the bed was not readily adjustable relative to the stand. Some amount of adjustability is desirable because rope slings have a tendency to stretch and sag. A solution was to add a pair of chains between the hooks at one end only of the bed. In that way, a four-point connection was maintained with a somewhat shorter length stand (as compared to traditional two-point stands) but which allowed for a limited range of adjustments to the hammock bed such as for tension and the like.

There has also been proposed to add chains between the hooks at both ends of the hammock bed to simulate two-point connections with the chains at each end angled together from the spreader bar to the stand. In other words, the spacing between the chains at the spreader bar is quite a bit larger than the spacing of the chains at the stand. While provision of four chains in this manner may provide a greater range of adjustability to the bed, a significant amount of sway characteristic of the traditional two-point hammocks is also introduced along with possible sacrifices in the length of the hammock stand.

SUMMARY OF THE INVENTION

There has been a desire to utilize rope sling hammock constructions having the wide range adjustability of the four-chain, four point connection hammock systems, but without significantly sacrificing stand length and, particularly, without reintroducing significant sway to the hammock bed. To this end, and in accordance with the principles of the present invention, a four point hammock system is provided in which the spacing between the hooks on the spreader bars is about equal to the spacing of the hooks on the stand such that each chain extends between the spreader bar and the stand support in a line generally parallel to the longitudinal axis of the rope sling hammock bed. As a consequence, the length of the stand may be made relatively short, akin to other rope sling four point construction with chains at one end and direct hook-to-hook connection at the other end, while having the wider range of adjustability of the angled chain four point connection systems without reintroducing excessive sway into the bed.

These and other objects and advantages of the present invention shall become apparent from the accompanying drawings and the detailed descriptions thereof.

BRIEF DESCRIPTION OF THE DRAWINGS

The accompanying drawings, which are incorporated in and constitute a part of this specification, illustrate an embodiment of the invention and, together with a general description of the invention given above, and the detailed description given below, serve to explain the principles of the invention.

DETAILED DESCRIPTION OF THE DRAWINGS

Figure 1:
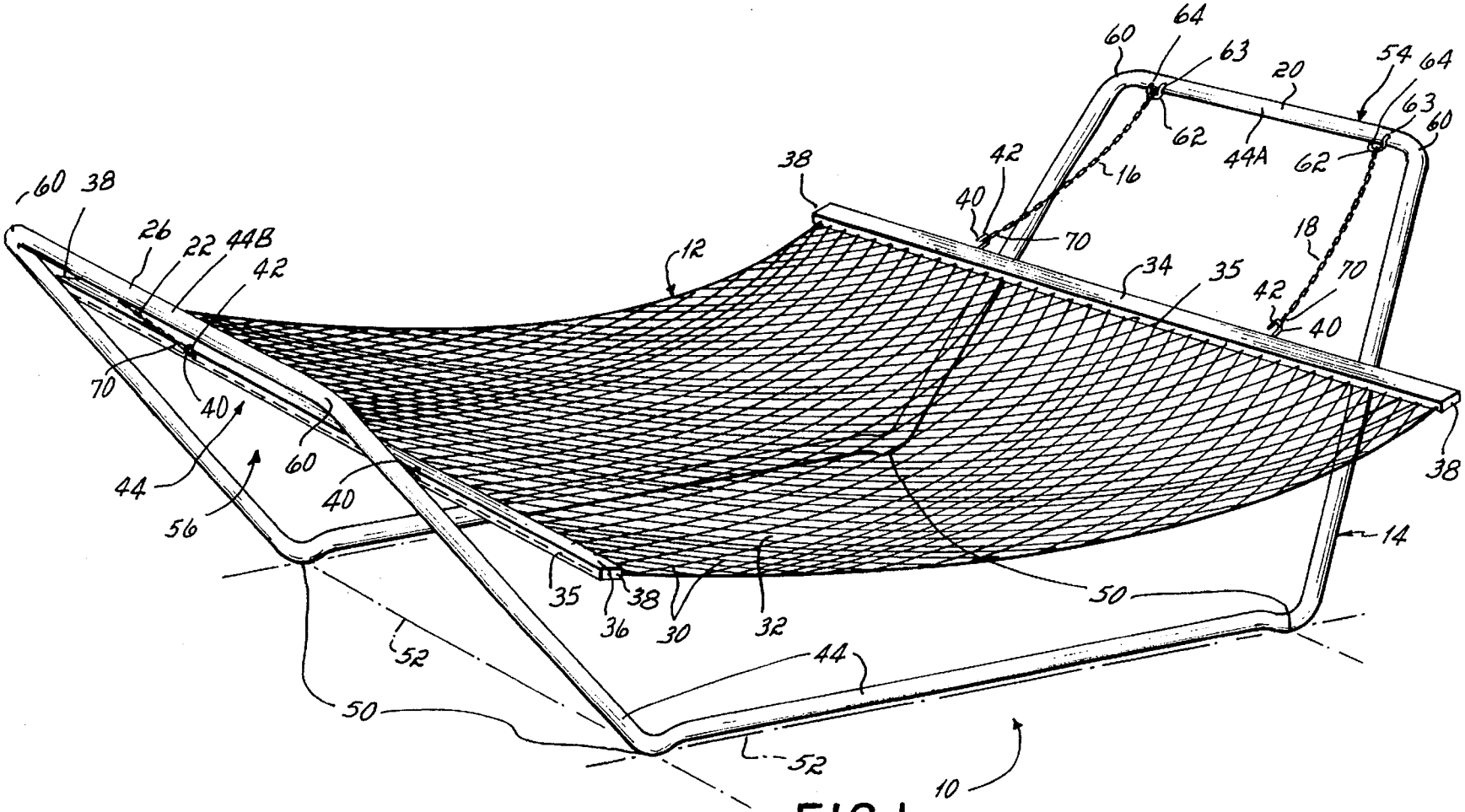
FIG. 1 is a perspective view of a four-point rope sling hammock system in accordance with the principles of the present invention, the bed of the system being shown in a full slack position.

With reference to FIG. 1 there is shown a four-point rope sling hammock system 10. Hammock system 10 includes a hammock bed 12 of rope sling construction and a stand 14 to which bed 12 is supportably attached by two chains 16, 18 at the head end 20 of hammock 10 and two chains 22, 24 at the foot end 26 of hammock 10.

Bed 12 extends along a longitudinal axis 28 between head 20 and foot 26 and has a plurality of 100% cotton ropes or cords 30 intertwined to define a web having a plurality of apertures 32 therethrough in conventional rope sling hammock bed format. The ropes 30 are connected at head end 20 and foot end 26 to respective oak spreader bars 34 and 36 such as by being strung through holes 35 in the bars 34, 36 as is conventional. Each spreader bar 34, 36 is about 64 inches long and extends generally transverse to longitudinal axis 28. Attached adjacent to or inboard from each end 38 of bars 34 and 36 is a connection element 40 such that bed 12 has four such connection elements 40. Each connection element 40 may be a metal rod that is wrapped around the spreader bar and has a protruding hook end 42.

Stand 14 is comprised of a plurality of steel 1½ inch diameter 12 gauge pipe segments 44 joined together such as by having telescopingly related ends (not shown). Stand 14 has along its bottom at least four points 50 which contact a ground surface 52 on which stand 14 is set. Two of the segments 44A and 44B are preferably 14 gauge pipes and are held above ground surface 52 to extend across and define the head end 54 and foot end 56 of stand 14. Segments 44A and 44B are support members which are positioned to be near head and foot spreader bars 34, 36, respectively. Members 44A and 44B may be about 36 inches long across the ends of stand 14 whereas the segments 44 along ground surface 52 are about 76 inches in length and spread apart about 54 inches such that members 44A, 44B are about 29 inches above ground surface 52.

Associated with each support member 44A, 44B adjacent to or inboard from each end 60 thereof is a connection element 62 which may be an S-shaped hook. One end of hook 62 is secured to the respective support member 44A or 44B such as by being received in a hole (63) in the member, whereas the other end of hook 62 defines a hook end 64. For purposes which will become clear, the pair of hooks 62 on support 44A at head end 54 of stand 14 are spaced apart a distance approximately equal to the spacing between connection elements 40 on the head spreader bar 34. Similarly, the spacing between hooks 62 on support 44B at foot end 56 is approximately equal to the spacing between connection elements 40 on the foot spreader bar 36. Preferably, the spacing between the connection points at each end of stand 14 is about equal and equidistant from the longitudinal axis 28 of bed 12. One possible spacing is about 28 inches (i.e., each hook end is about 14 inches away from axis 28 measured in a direction transverse to the axis).

Figure 2:
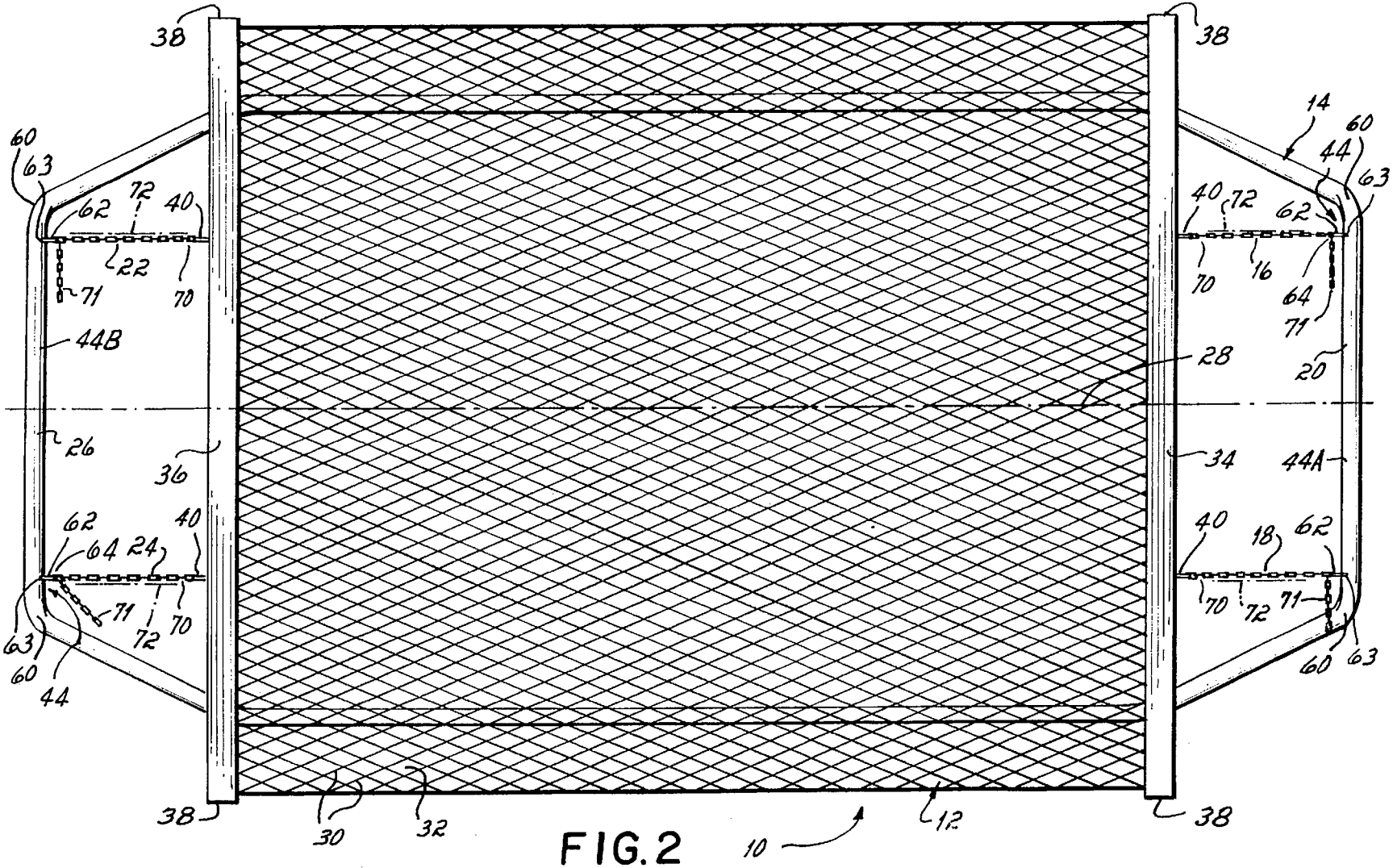
FIG. 2 is a top plan view of the hammock system of FIG. 1, the bed of the system being shown in a taut position.

Two of the chains 16, 18 extend between and interconnect head spreader bar 34 and head support member 44A. The proximal end 70 of each chain 16, 18 is attached over the hook end 42 of respective connection elements 40 associated with head spreader bar 34. The chains 16, 18 may be attached anywhere along their respective lengths outboard of proximal end 70 to the hook end 42 of respective connection elements 62 associated with head support member 44A. Similarly, the other two chains 22, 24 extend between and interconnect foot spreader bar 36 and foot support member 44B. The proximal end 70 of each chain 22, 24 is attached over the hook end 42 of respective connection elements 40 associated with foot spreader bar 36. The chains 22, 24 may be attached anywhere along their respective lengths outboard of proximal end 70 to the hook end 62 of respective connection elements 62 associated with foot support member 44B with the unused portion (e.g., as at 71 in FIG. 2) simply hanging down from connection elements 62. Consequently, each chain may be connected to the stand independent of the other chains whereby there are four, full points of adjustability of hammock bed 12 relative to stand 14.

Additionally, by providing generally equal spacing between the connection points of the spreader bar and support member at each end of the hammock 10, each chain will extend between its associated spreader bar and support member in a line (as at 72) generally parallel to the longitudinal axis 28 of bed 12. Consequently, bed 12 is supported with a stand that is shortened relative the bed when compared to a hammock bed of the same length in a conventional two-point connection system, but without introducing undesirable sway characteristic of those two-point systems. By way of example, support members 44A, 44B may be spread about 10.5 feet apart as compared with spacing of about 16 feet were bed 12 to be supported by a two-point stand. Similarly, bed 12 may be made more comfortable and durable by being about 90 inches long (between spreader bars 34, 76) and using some 700 feet of cord 30 as opposed to about 500 feet of cord in a conventional bed (which would be about 84 inches long). Moreover, by utilizing a parallel system of four chain connections, hammock bed 12 may be flipped around (head to foot) or flipped over (top to bottom) for use as desired. Finally, with the four-point parallel chain connection of the present invention, the hammock is not prone to tipping, even if one were to sit near an end 20 or 26 of bed 12.

In use, proximal ends 70 of chains 16, 18 are mounted to hook ends 42 at bar 34 and proximal ends 70 of chains 22, 24 are mounted to hook ends 42 at bar 36. Bed 12 is mounted to stand 14 by connecting chains 16, 18 outboard of proximal ends 70 to hooks 64 on head support member 44A of stand 14 and connecting chains 22, 24 outboard of proximal ends 70 to hooks 64 on foot support member 44B of stand 14. Bed 12 may then be used to lay upon as is conventional. Also, bed 12 may be adjusted relative to stand 14 by selectively connecting a respective chain 16, 18, 22 and/or 24 along its length to the associated hook 64 to pull bed 12 taut or loosen same as desired.

By virtue of the foregoing, there is thus provided a four-point rope sling hammock system with the advantage of four points of chain connection between the bed and the stand, but without the drawbacks of prior four-point connection systems.

While the present invention has been illustrated by the description of an embodiment thereof, and while the embodiment has been described in considerable detail, it is not intended to restrict or in any way limit the scope of the appended claims to such detail. Additional advantages and modifications will readily appear to those skilled in the art. For example, hooks 64 could be permanently attached to support member 44A, 44B or other connection elements may be utilized. Similarly, proximal ends 70 of the chains could be directly and permanently attached to spreader bars 34, 36. The invention in its broader aspects is therefore not limited to the specific details, representative apparatus and methods and illustrative examples shown and described. Accordingly, departures may be made from such details without departing from the spirit or scope of the general inventive concept.

Having described the invention, what is claimed is:

1. A four-point hammock system comprising:

a hammock bed extending along a longitudinal axis between head and foot ends, the hammock bed being of a rope sling construction and having a spreader bar at each end of the hammock bed generally transverse to the longitudinal axis and to which the ropes are connected;

a stand adapted to rest on a ground surface and including head and foot support members, the stand defining at least two points of ground surface contact below the head support member and at least two points of ground surface contact below the foot support member whereby to stably rest the stand on said ground Surface; and four chains, a first pair of which extend between and interconnect the spreader bar and support member at the head end and a second pair of which extend between and interconnect the spreader bar and the support member at the foot end, with each of the chains extending in a line generally parallel to the longitudinal axis of the hammock bed, wherein each of the chains has an inner end link, an outer end link and a plurality of links between the end links so as to allow for adjustability of the hammock bed relative to the stand at both the head and foot ends of the hammock bed.

2. The hammock system of claim 1 wherein each spreader bar has opposite ends and the chair of each pair of chains are spaced apart so as to be connected to the associated spreader bar adjacent opposite ends thereof.

3. The hammock system of claim 1 wherein the support members extend generally transverse to the longitudinal axis of the hammock bed and are supported above the ground surface.

4. The hammock system of claim 1 further comprising two connection elements on each of the support members, each chain being selectively connectable along a length thereof to the associated connection element whereby to facilitate adjustment of the hammock bed relative to the stand.

5. A four-point hammock system comprising:

a hammock bed extending along a longitudinal axis between head and foot ends, the hammock bed being of a rope sling construction and having a spreader bar at each end of the hammock bed generally transverse to the longitudinal axis and to which the ropes are connected, each spreader bar supporting a pair of first connection elements spread apart a predetermined distance;

a stand adapted to rest on a ground surface and including head and foot support members, each support member supporting a pair of second connection elements spaced apart the predetermined distance, the stand defining at least two points of ground surface contact below the head support member and at least two points of ground surface contact below the foot support member whereby to stably rest the stand on said ground surface; and four chains, a first pair of which extend between and interconnect the first and second connection elements of the spreader bar and support member at the head end and a second pair of which extend between and interconnect the first and second connection elements of the spreader bar and the support member at the foot end such that each of the chains extends in a line generally parallel to the longitudinal axis of the hammock bed, wherein each of the chains has an inner end link, an outer end link and a plurality of links between the end links so as to allow for adjustability of the hammock bed relative to the stand at both the head and foot ends of the hammock bed.

* * * * *